US005775035A

United States Patent [19]

Papin

[11] Patent Number: 5,775,035

[45] Date of Patent: Jul. 7, 1998

[54] PLASTIC POWER POLE SYSTEM

[76] Inventor: Neal Papin, 1212 N. Linn St., Bay City, Mich. 48706

[21] Appl. No.: 762,317

[22] Filed: Dec. 9, 1996

[51] Int. Cl.[6] ..... E04H 12/24

[52] U.S. Cl. ..... 52/100; 52/40; 52/736.2; 52/726.4; 52/731.4; 248/909; 248/295.11

[58] Field of Search ..... 52/40, 736.2, 100, 52/697, 309.1, 726.4, 731.4, 736.1, 98; 248/909, 295.11, 125.3, 125.1

[56] References Cited

U.S. PATENT DOCUMENTS

| | | | |
|---|---|---|---|
| D. 259,513 | 6/1981 | Whatley . | |
| 2,870,793 | 1/1959 | Bailey | 52/40 X |
| 3,100,555 | 8/1963 | Ashton | 52/309.1 |
| 3,284,971 | 11/1966 | Attwood | 52/100 |
| 3,896,858 | 7/1975 | Whatley . | |
| 4,246,732 | 1/1981 | Frehner | 52/309.1 X |
| 4,262,047 | 4/1981 | Barnett et al. | 52/40 X |
| 4,312,162 | 1/1982 | Medney | 52/40 X |
| 4,803,819 | 2/1989 | Kelsy | 52/726.4 X |
| 5,043,536 | 8/1991 | DeBartolo | 174/65 R |
| 5,060,437 | 10/1991 | Parsons et al. . | |
| 5,492,579 | 2/1996 | Hosford et al. . | |
| 5,605,017 | 2/1997 | Fingerson et al. | 52/40 |

*Primary Examiner*—Robert Canfield

[57] ABSTRACT

A plastic power pole system has a pole, a syncline support member secured to the upper portion of the pole, and a horizontal support member secured to both the pole and the syncline support member. The horizontal support member supports a plurality of conventional insulators which project vertically upward. The pole further includes a number of knockout members, the knockout members removable to form apertures for receiving a fastener.

8 Claims, 3 Drawing Sheets

10
20
40
34
32

30
34
20

22
22
32
30
32
20
42
40
42
42

FIG 5
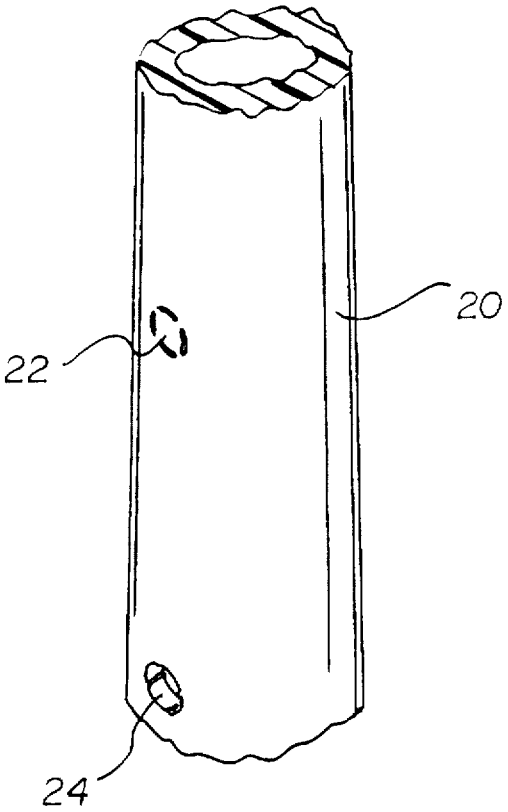
FIG 6
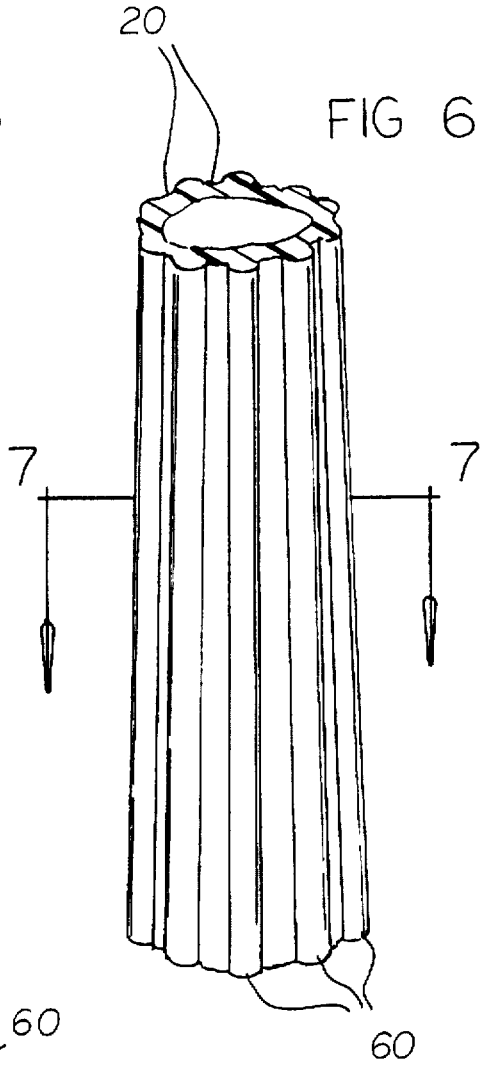
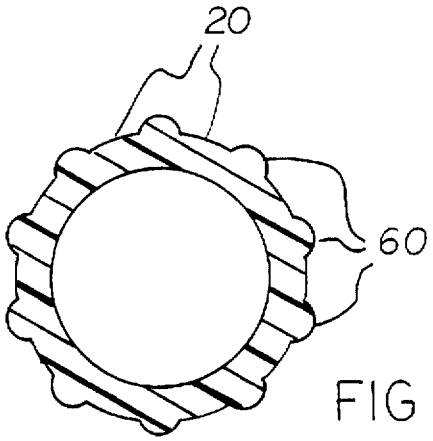
FIG 7

PLASTIC POWER POLE SYSTEM

BACKGROUND OF THE INVENTION

1. Field of the Invention

The present invention relates to Pole Devices and more particularly pertains to a new Plastic Power Pole System for preventing rotting and deterioration of conventional wood poles, and for saving construction time of power lines and improving aesthetics of a power line.

2. Description of the Prior Art

The use of Pole Devices is known in the prior art. More specifically, Pole Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Pole Devices include U.S. Pat. No. 4,312,162; U.S. Pat. No. 4,246,732; U.S. Pat. No. 4,769,967; U.S. Pat. No. 4,194,080; U.S. Pat. No. 4,314,434 and U.S. Design Patent 247,629.

While these devices fulfill their respective, particular objectives and requirements, the aforementioned patents do not disclose a new Plastic Power Pole System. The inventive device includes a pole approximately the length of a conventional power pole, a syncline member secured to the upper portion of the telescopic pole, and a horizontal support member secured to the upper portion of the syncline member and the pole, where the present invention is constructed from a rigid plastic or fiber glass.

In these respects, the Plastic Power Pole System according to the present invention substantially departs from the conventional concepts and designs of the prior art, and in so doing provides an apparatus primarily developed for the purpose of preventing rotting and deterioration of conventional wood poles, and for saving construction time of power lines and improving aesthetics of a power line.

SUMMARY OF THE INVENTION

In view of the foregoing disadvantages inherent in the known types of Pole Devices now present in the prior art, the present invention provides a new Plastic Power Pole System construction wherein the same can be utilized for preventing rotting and deterioration of conventional wood poles, and for saving construction time of power lines and improving aesthetics of a power line.

The general purpose of the present invention, which will be described subsequently in greater detail, is to provide a new Plastic Power Pole System apparatus and method which has many of the advantages of the Pole Devices mentioned heretofore and many novel features that result in a new Plastic Power Pole System which is not anticipated, rendered obvious, suggested, or even implied by any of the prior art Pole Devices, either alone or in any combination thereof.

To attain this, the present invention generally comprises a pole approximately the length of a conventional power pole, a syncline member secured to the upper portion of the pole, and a horizontal support member secured to the upper portion of the syncline member and the pole, where the present invention is constructed from a rigid plastic or fiber glass.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Plastic Power Pole System apparatus and method which has many of the advantages of the Pole Devices mentioned heretofore and many novel features that result in a new Plastic Power Pole System which is not anticipated, rendered obvious, suggested, or even implied by any of the prior art Pole Devices, either alone or in any combination thereof.

It is another object of the present invention to provide a new Plastic Power Pole System which may be easily and efficiently manufactured and marketed.

It is a further object of the present invention to provide a new Plastic Power Pole System which is of a durable and reliable construction.

An even further object of the present invention is to provide a new Plastic Power Pole System which is susceptible of a low cost of manufacture with regard to both materials and labor, and which accordingly is then susceptible of low prices of sale to the consuming public, thereby making such Plastic Power Pole System economically available to the buying public.

Still yet another object of the present invention is to provide a new Plastic Power Pole System which provides in the apparatuses and methods of the prior art some of the advantages thereof, while simultaneously overcoming some of the disadvantages normally associated therewith.

Still another object of the present invention is to provide a new Plastic Power Pole System for preventing rotting and deterioration of conventional wood poles, and for saving construction time of power lines and improving aesthetics of a power line.

Yet another object of the present invention is to provide a new Plastic Power Pole System which includes a pole approximately the length of a conventional power pole, a syncline member secured to the upper portion of the pole, and a horizontal support member secured to the upper portion of the syncline member and the pole, where the present invention is constructed from a rigid plastic or fiber glass.

Still yet another object of the present invention is to provide a new Plastic Power Pole System that utilizes recyclable plastic thereby saving trees and reducing landfills.

Even still another object of the present invention is to provide a new Plastic Power Pole System that is safer than conventional wood poles to drivers of cars because it will not crush a car like a conventional wood pole.

Still another object of the present invention is to provide a new Plastic Power Pole System that utilizes knockout members thereby eliminating the requirement of linemen to drill holes during construction or repair of the pole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric view of the pole in relation to the syncline support member and the horizontal support member.

FIG. 6 is another embodiment of the present invention disclosing the vertical support ribs extending from the pole surface outwardly parallel to the longitudinal axis of the pole.

FIG. 7 is a cross sectional view taken along line 7—7 of FIG. 6 further disclosing the vertical support ribs extending outwardly from the pole surface to the pole.

DESCRIPTION OF THE PREFERRED EMBODIMENT

Figure 1:
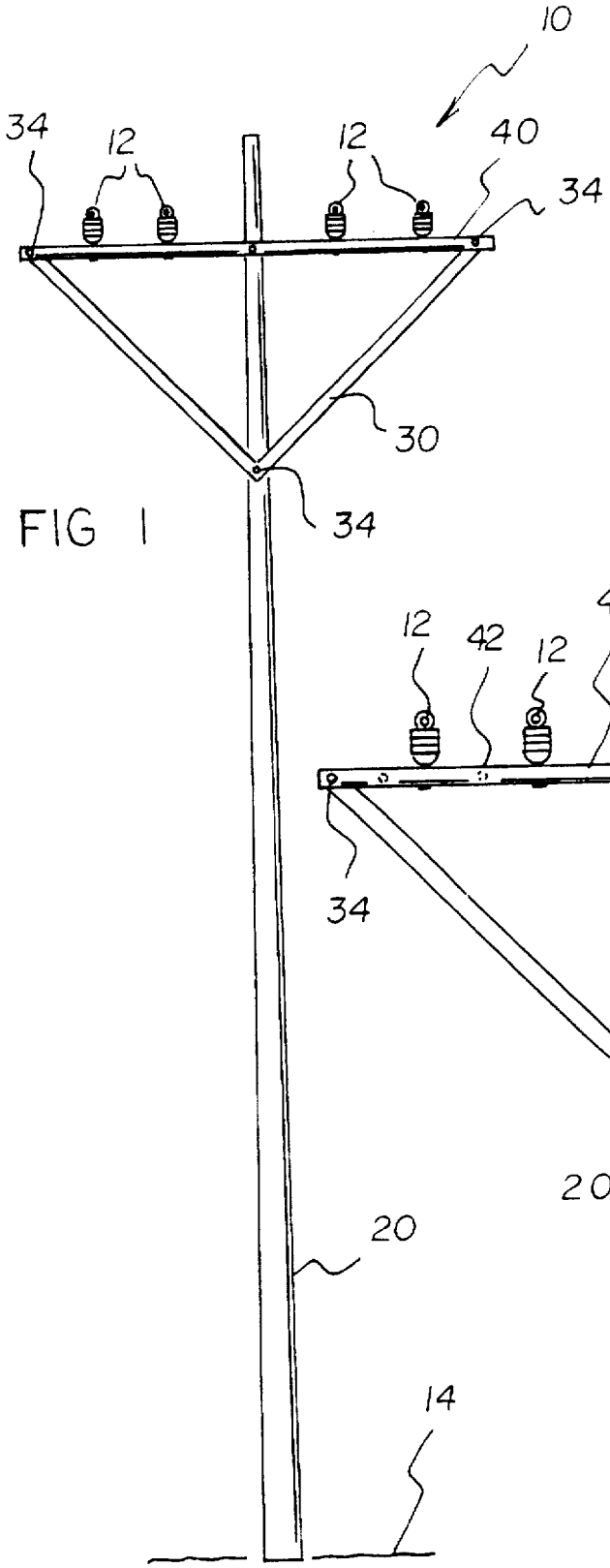
FIG. 1 is a frontal view of a new Plastic Power Pole System according to the present invention disclosing the syncline support member secured to the pole and the horizontal support member.
Figure 2:
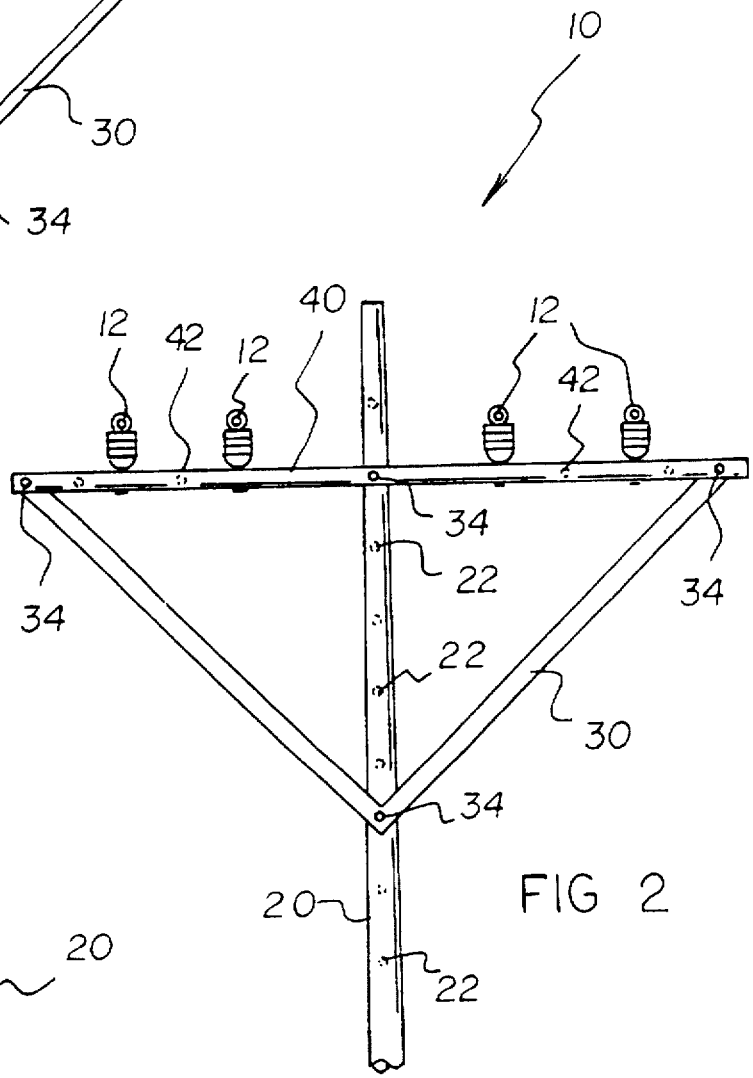
FIG. 2 is a magnified view of the upper portion of the present invention disclosing the pole knockout members and the conventional insulators secured to the horizontal support member.
Figures 3, 4:
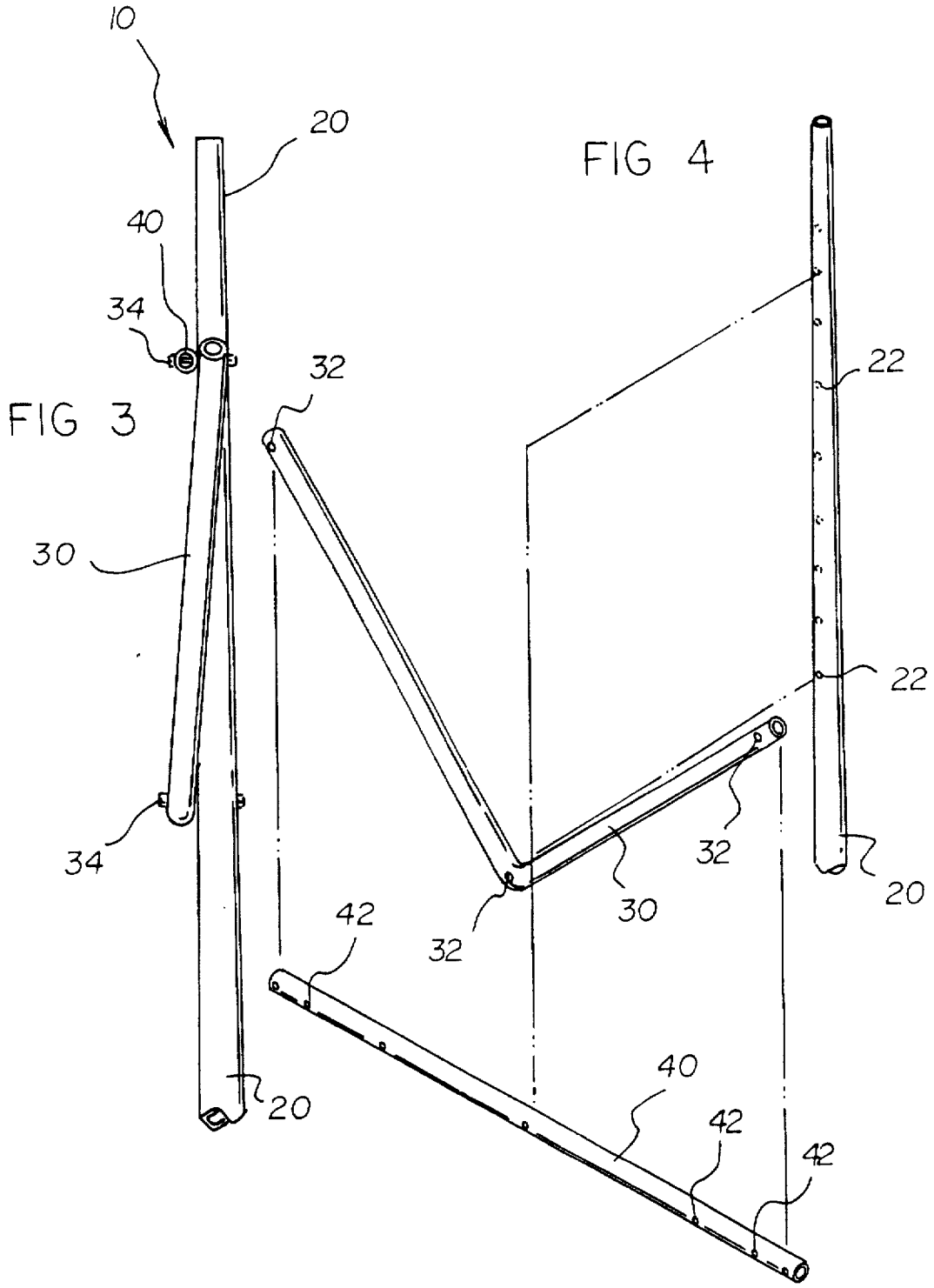
FIG. 3 is a side view of the invention disclosing the fastener projecting through the securing aperture.
FIG. 4 is an exploded isometric illustration of the present invention.

With reference now to the drawings, and in particular to FIGS. 1 through 7 thereof, a new Plastic Power Pole System embodying the principles and concepts of the present invention and generally designated by the reference numeral 10 will be described.

More specifically, it will be noted that the Plastic Power Pole System 10 comprises a pole 20 the length of a conventional power pole, a syncline support member 30 secured to the upper portion of the pole 20, and a horizontal support member 40 centrally secured orthogonally to the upper portion of the pole 20 and secured to syncline support member 30, which supports a plurality of conventional insulators projecting vertically upward.

As best illustrated in FIGS. 1 through 5, it can be shown that the pole 20 includes a plurality of pole knockout members 22 which can be easily removed forming a knockout aperture 24 which receives a fastener 34. The syncline support member 30 includes a plurality of securing aperture 32 corresponding to the knockout aperture 24 of the pole 20 and a plurality of support knockout members 42 within the horizontal support member 40 allowing a plurality of fasteners 34 to project through securing the syncline support member 30 to the telescopic pole 20 and the horizontal support member 40. The pole 20, the syncline support member 30, and the horizontal support member 40 are preferably hollow as best disclosed in FIGS. 4 and 5 of the drawings. Preferably, the pole 20, the syncline support member 30, and the horizontal support member 40 are constructed from either a rigid plastic material or fiber glass material.

As shown in FIGS. 6-7 of the drawings, another embodiment for the pole 20 includes a plurality of vertical support ribs 60 secured to the exterior surface projecting substantially parallel to the longitudinal axis of the pole 20.

In use, the user simply removes the required the pole knockout members 22 and the required support knockout members 42 before assembly of the present invention. The user then mounts the pole 20 within the ground 14 and then secures the horizontal support member 40 onto the upper portion of the pole 20. The user then mounts the syncline support member 30 onto the pole 20 and the horizontal support member 40 forming a rigid structure for supporting unnumbered power lines.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Plastic Power Pole System comprising:

a pole;

a syncline support member secured to an upper portion of the pole;

a horizontal support member centrally secured orthogonally to the upper portion of the pole and secured to the syncline support member the horizontal support member supporting a plurality of conventional insulators projecting vertically upward; and a plurality of pole knockout members in the pole, said knockout members easily removable for forming a knockout aperture which receives a fastener.

2. The Plastic Power Pole System of claim 1, wherein the syncline support member includes a plurality of securing apertures corresponding to the knockout aperture of the pole and a plurality of support knockout members within the horizontal support member allowing a plurality of fasteners to project through securing the syncline support member to the pole and the horizontal support member.

3. The Plastic Power Pole System of claim 2, wherein the pole, the syncline support member, and the horizontal support member are hollow.

4. The Plastic Power Pole System of claim 3, wherein the pole includes a plurality of vertical support ribs extending from the exterior surface of the pole, the ribs projecting substantially parallel to the longitudinal axis of the pole.

5. The Plastic Power Pole System of claim 4, wherein the pole, the syncline support member, and the horizontal support member are constructed from a rigid plastic material.

6. The Plastic Power Pole System of claim 4, wherein the pole, the syncline support member, and the horizontal support member are constructed from a rigid fiber glass material.

7. The Plastic Power Pole System of claim 1, wherein the pole, the syncline support member, and the horizontal support member are hollow.

8. The Plastic Power Pole System of claim 1, wherein the pole includes a plurality of vertical support ribs extending from the exterior surface of the pole, the ribs projecting substantially parallel to the longitudinal axis of the pole.

* * * * *